United States Patent [19]

Frazer

[11] Patent Number: 5,073,407

[45] Date of Patent: Dec. 17, 1991

[54] METHOD OF TREATING A SURFACE

[75] Inventor: Richard Frazer, Williamsville, N.Y.

[73] Assignee: Crescent Marketing, Inc., Eden, N.Y.

[21] Appl. No.: 552,702

[22] Filed: Jul. 13, 1990

[51] Int. Cl.[5] ..... B05D 5/00; B05D 3/12

[52] U.S. Cl. ..... 427/160; 427/165; 427/322; 427/327; 427/355; 427/369; 427/384; 427/421; 427/168

[58] Field of Search ..... 427/160, 369, 327, 322, 427/421, 355, 384, 165

[56] References Cited

U.S. PATENT DOCUMENTS

| | | | |
|---|---|---|---|
| 3,104,175 | 9/1963 | Marx et al. | 427/160 |
| 4,218,250 | 8/1980 | Kasprzak | 106/3 |
| 4,622,246 | 11/1986 | Takeuchi | 427/348 |
| 4,781,946 | 11/1988 | Takeuchi | 427/327 |
| 4,900,592 | 2/1990 | Hahn | 427/385.5 |
| 4,913,967 | 4/1990 | Bilhorn | 427/369 |

*Primary Examiner*—Janyce Bell

*Attorney, Agent, or Firm*—Grimes & Battersby

[57] ABSTRACT

A method of treating a painted vehicle or glass to form a film which protects the surface and can be easily cleaned. A treatment solution including a surfactant mixed with water is rubbed into sections of the surface being protected until a tacky residue forms on the surface. The tacky residue is then rubbed into the surface until the surface is wiped free of any streaks.

21 Claims, No Drawings

METHOD OF TREATING A SURFACE

BACKGROUND OF THE INVENTION

1. Field of the Invention

The present invention relates generally to a method of treating a surface and more particularly, to a surface treatment used for window glass, painted surfaces of an automobile and the like which provides a film that functions as an effective protection against spotting, staining and pitting caused by pollution and hard water deposits.

Cleaners have been employed to clean dirt and grime from a surface, such as window glass or the painted surface of an automobile. However, these cleaners have not been known to apply a film or layer of protection on the treated surface.

In recent years, there has been an increased concern over the damage done to clear coat finishes on automobiles from exposure to pollution and hard water deposits. Solvents and abrasives for cleaning can harm clear coat finishes. Silicone and other polymer resins can seal in contaminants, suffocate paint and interfere with proper curing and adhesion of new vehicle paint. Heretofore, no such products have incorporated resistance against the effects of pollution and hard water deposits and ultraviolet ray resistant qualities while providing continuous cleansing and neutralizing of contaminants.

2. Description of the Prior Art

U.S. Pat. No. 4,476,269, which issued on Oct. 9, 1984 to Wilk et al., is directed to polymer dispersions or emulsions which are suitable to form a temporary protective coating of an automobile chassis. The polymer dispersion includes nonylphenoxy-(polyethoxy)-disodium sulfosuccinate. However, this patent fails to provide for cleaning of the treated surface, a sunscreen barrier and the ingredients of the present invention.

U.S. Pat. No. 4,622,246, which issued on Nov. 11, 1986, to Takeuchi et al. and U.S. Pat. No. 4,781,946, which issued on Nov. 1, 1988, to Takeuchi are both directed to vehicle polishing methods and apparatus. These patents provide applying a primary treating agent containing anionic surfactant in foamy form to the body surface of a vehicle. As with the Wilk et al. patent, these patents fail to provide for cleaning of the treated surface, a sunscreen barrier or film, let alone the combination of ingredients of the present invention.

It is submitted that in these two patents, the sulfosuccinate and the anoinic surfactant are used to stabilize or emulsify the product prior to application, but do not actually become a part of the coating system.

U.S. Pat. No. 4,218,250, which issued on Aug. 19, 1980 to Kasprzak, is directed to a polish formulation. The subject polish formulation has durability to water and detergents. This formulation contains surfactants which include anionic, cationic and non-ionic surfactants. Among the specific surfactants named is a polyhydric alcohol-fatty acid ester with unesterified hydroxy groups. This patent fails, however, to provide for cleaning of the treated surface, a sunscreen barrier or film, let alone the combination of ingredients of the present invention.

U.S. Pat. No. 4,632,848, which issued on Aug. 19, 1980 to Gosset et al., is directed to a composition and process for forming a temporary protective coating on an article, such as an automobile. This composition includes a wetting agent which can be anionic, cationic, non-anionic or amphoteric surfactants. Sulfates and sulfonates are included in this category of wetting agents. As with the previously discussed patents, this patent fails to provide for cleaning of the treated surface, a sunscreen barrier or film and the combination of ingredients of the present invention.

It is submitted that these surfactants are also used to help get waxes and silicones into solution, and that they have little or nothing to do with surface or substrate protection.

SUMMARY OF THE INVENTION

Against the foregoing background, it is a primary object of the present invention to provide a method of treating a surface which cleans the surface to which it is applied.

It is another object of the present invention to provide a method for treating a surface which substantially resists the effects of pollution and hard water deposits such as spotting, staining and pitting.

It is a further object of the present invention to provide a method of treating a surface which forms an ultraviolet ray resistant film on the treated surface.

It is a still further object of the present invention to provide a method of treating a surface which provides continuous cleansing and neutralizing of contaminants on the treated surface.

It is a yet further object of the present invention to provide a method of treating a surface which is relatively easy to apply.

It is still another object of the present invention to provide a method of treating a surface which is relatively inexpensive to employ.

To the accomplishments of the foregoing objects and advantages, the present invention, in brief summary, includes a method of treating a surface. The method comprises the following steps. First, a surfactant is mixed with water to form a liquid solution. Then, the solution is applied to sections of the surface being protected. Next, the solution is rubbed into the wetted surface until a greasy residue forms on the surface and dries in a tacky state. Finally, the tacky residue is rubbed into the surface until the surface is wiped free of any streaks.

When the liquid solution is to be applied as a spray, such as for window glass on commercial buildings and residences, alcohol can be mixed with the surfactant and water to thin out the solution for ease of application. To remove the tacky residue from window glass, a powdery substance is dusted on the glass surface to absorb the residue.

BRIEF DESCRIPTION OF THE PREFERRED EMBODIMENTS

The method of treating a surface of the present invention is adapted for use on certain surfaces. It is known that the solution forming the treatment solution is effective on surfaces, such as window glass of buildings and the paint finish of an automobile, to remove dirt, dust, grime and neutralize contaminants such as acid rain. Further, the surface, such as the glass of buildings, preferably commercial buildings, or automobile paint finish, having been cleaned by the solution has a coating thereon. The protective coating on the cleaned surface dramatically reduces spotting, staining and pitting caused by pollution and hard water deposits. The coating has also been found to improve the resistance of the automobiles paint to degradation from ultraviolet rays. Accordingly, the paint finish of the automobile lasts longer and, naturally retains its bright finish for a longer period of time.

An extraordinary aspect of the protective coating is that it rinses clear with ordinary tap water and dries spot-free without costly water softening apparatus and no hand drying.

Although other applications for the surface coating system are still being developed, it is anticipated that the coating system can be used on many types of surfaces, including those that have been treated with certain paints to enable trouble free cleaning, protection against the environment and resistance to ultraviolet rays.

The surface treatment solution comprises a non-soluble, water dispersible surfactant. Specifically, the preferred surfactant is a liquid form, di-ester sodium dioctyl sulfosuccinate. The preferred surfactant is sold under the tradename EMCOL 4500 by Witco Chemical, Organics Division. The preferred surfactant exhibits wetting, foaming, dispersing, detergent and emulsification properties over a wide range of water hardnesses. This surfactant has the following typical physical properties.

| | |
|---|---|
| Appearance | Clear, light viscous liquid |
| Solids, Content, | 70% |
| pH, 3% aqueous dispersion | 65 |
| Acid Value, mg KOH/gm | 30 |
| Specific Gravity at 20/4° C. | 1.10 |
| Surface Tension, 0.05% solids, | 26.3 dynes/cm |
| Foam Height, Ross-Miles, at 25° C. 0.05% solids in distilled water, Initial, | 160 mm |
| 5 min, | 15 mm |
| Draves Wetting Test, % solids for 10 sec. sink time | 0.035% |
| Calcium Tolerance, 0.25% Solids, ppm $CaCO_3$ | 216 |
| Lime Soap Dispersing Power, (Modified Borghetty and Deigman Method | 57% |
| Solubility In | |
| Water | Dispersible |
| Alcohol (Ethanol 3A + 5% Isopropancl) | Dispersible |
| Perchloroethylene | Soluble |
| Carbon Tetrachloride | Soluble |
| Stoddard Solvent | Soluble |

For applications of the treatment solution to the painted surface of a motor vehicle or similar apparatus, the surfactant can be applied directly to the surface. However, the surfactant in its undiluted state is very sticky and relatively difficult to apply to the surface being treated. Thus, it has been found preferable to mix up to about 15% by volume of surfactant with the remainder of the total volume being water. Preferably, between about 5% to about 15% by volume of surfactant is mixed with the remainder of the total volume being water. More preferably, it has been found that an effective solution contains about 9% by volume of surfactant to the total solution volume. As the percentage of volume of surfactant to water decreases below 5%, the solution looses it beneficial effect and is believed to degenerate too quickly.

When the surfactant is mixed with water in the preferred range, it has the following typical physical and chemical characteristics:

| | |
|---|---|
| Boiling Point: | NAV |
| Flash Point: | No Flash using TAG closed CUP/ASTM D-56 |
| Specific Gravity ($H_2O$ = 1): | .927 @ 20° C. |

-continued

| | |
|---|---|
| Vapor Density (Air = 1): | Greater |
| Evaporation Rate (BA = 1): | Slower than Butyl Acetate |
| % Solids: | 10 |
| Weight (lb./gal/): | 7.81 |
| Solubility in Water: | Complete |
| pH: | 7.0 |
| Appearance & Odor: | (a) Blue if a dye is used or, (b) Clear to amber without dye, surfactant odor unless fragrance is added viscous liquid |
| Viscosity: | 7500 cp using #5 Zahn cup @ 20° C. |
| Flammability Limits: | NA |

The treatment solution can also include an additive which causes the surface coating to be resistant to ultraviolet ray deterioration. The additive can be an ultraviolet stabilizer such as UVINUL N-539 sold by BASF Corporation, Chemicals Division of Rensselear, NY. This additive has a formulation of 2-ethylhexyl-2-cyano-3,3-diphenylacrylate and the following properties:

| Properties | |
|---|---|
| Physical Form | Liquid |
| Molecular Weight | 361 |
| Melting Point °C. | −10 |
| Color | Pale Yellow |
| Specific Gravity | 1.0478 |
| % Purity | 94 |
| Solubility (% by Weight, 30° C.) | |
| Water | Immiscible |
| Methanol | Miscible |
| Ethyl Acetate | Miscible |
| MEK | Miscible |
| Toluene | Miscible |

The ultraviolet stabilizer additive can be added to the treatment solution of surfactant and water in a preferred range of about 0.1% to about 1% by volume of additive to the total solution volume. A more preferred range is about 0.1% to about 0.5% by volume of additive and a most preferred amount is about 0.2% by volume of additive to the total solution volume. Below about 0.1% of the total solution volume, no significant results have been found.

Prior to applying the liquid treatment solution to the finished surface of a vehicle, the surface should preferably be prepared so as to be clean, dry and free from wax and other coatings. Immediately after the solution has been applied and before it has a chance to dry, it is rubbed into the surface using a firm, circular motion of an application cloth until the solution is spread evenly over the surface being treated. After rubbing, the surface should be covered with a greasy but not gummy residue. The steps of applying and rubbing are continued until the solution is applied to each section of the vehicle, such as the trunk, hood, etc.

The greasy residue dries tacky. The tacky residue is then rubbed into the finish of the vehicle with a clean dry cloth until the residue disappears and a glossy finish is achieved. It is believed, however, that a coating of the treatment solution remains on the surface being treated. The step of rubbing includes moving the dry cloth with a firm circular motion until the surface is wiped clear of any streaks. It has been found that the use of an orbital buffer is the most effective way of rubbing the solution into the finish. If during the process of rubbing the surface becomes dry and unpliable, additional solution or water can be lightly applied to the surface being treated.

The paint of a vehicle which has been treated with the solution will effectively resist acid and alkaline pollution, hard water deposits, excessive heat and cold, harsh sunlight, detergent washing and salt water immersions. To clean a coated car, simply spraying water through a hose will remove the surface dirt, and light rubbing with a cloth or sponge will remove dirt that accumulates during driving. The car can be rinsed with ordinary tap water and will dry spot free without the need of hand-drying.

While the present invention is particularly useful for applications to vehicles such as automobiles, it can also be effectively used in treating glass windows of buildings, such as commercial buildings and residences. Treating glass windows can be particularly beneficial because the treated glass sheds dirt and spots and dramatically reduces cleaning and maintenance. After the complete application of the treatment solution, the windows can be cleaned by simply spraying them with tap water through a garden hose. After spraying, no wiping or drying is necessary. Besides the beneficial ease of cleaning, the treatment solution contains no solvents, noabrasives, no silicone and is 100% biodegradable. Moreover the solution is safe for hands, the environment and the window trim.

For applications of the treatment solution to window glass or similar glass surfaces, undiluted surfactant can be applied directly to the glass surface. However, the surfactant in its undiluted state is very sticky and difficult to apply to the surface being treated. Thus, it has been found preferable to mix water with the solution of surfactant to between about 5% to about 15% by volume of surfactant to the total solution volume. More preferably, it has been found that an effective solution contains about 7% by volume of surfactant to the total solution volume. When the percentage of volume of the surfactant to the water decreases to below the lower limit of about 5%, the beneficial effects of the coating system are thought to degenerate rather quickly.

In applying the treatment solution to the glass surfaces, it is particularly advantageous to spray the solution onto the window. To decrease the stickiness of the solution, it has been found beneficial to mix alcohol with the solution of surfactant and water. Preferably, the above ranges of surfactant and water are mixed with between about 1% and about 5% by volume of alcohol to the total solution volume. Most preferably, the surfactant and water are mixed with about 2% by volume of alcohol to the total solution volume. A solution containing more than about 5% of alcohol would not be desirable because the solution would be too flammable. A solution containing less than about 1% by volume of alcohol to the total solution would not be operable because it would be too viscous for effective spraying. It is, however, within the terms of the present invention to provide an effective solution of surfactant and water without any alcohol.

The solution of surfactant, water and alcohol can, if desired, also includes an additive which causes the resultant protective surface coating to be resistant to ultraviolet ray deterioration. The additive can be an ultraviolet stabilizer such as UVINUL N-539 described hereinbefore.

The additive can be added to the solution of surfactant, water and alcohol in a preferred range of about 0.1% to about !% by volume of stabilizer to the total solution volume. A more preferred range is about 0.1% to about 0.5% of stabilizer and a most preferred amount is about 0.2% of stabilizer to the total solution volume. Below about 0.1% of the total solution volume, no significant results have been found. It is further within the terms of the present invention to provide an operable solution without the ultraviolet stabilizer additive.

Prior to applying the liquid solution containing surfactant, water, alcohol and additive (if desired) to window glass, the glass surface should preferably be clean and dry. Then a small amount of the solution is rubbed onto the glass using firm, back and forth directional movements. Typically these movements are in a horizontal direction but any direction will suffice. The treated surface should appear greasy but not gummy. The surface is then allowed to dry for a period of about ten or more minutes until a tacky residue forms. The solution is again applied to the window using a motion substantially perpendicular to the first movements. Assuming the first movements to be in a horizontal direction, these second movements would be in the vertical direction. The surface is again allowed to dry for a period of about ten minutes or more minutes until the surface has a tacky residue.

To remove the tacky residue, the treated glass can be initially wiped with dry clean cloths. The treated glass surface is then dusted with a powdery substance capable of absorbing excess residue and polishing the treated surface smooth. Examples of a suitable substance for dusting include corn starch and diatomaceous earth. For large windows, it can be advantageous to use an orbital buffer to wipe the treated surface free from any tacky residue. In areas where residue remains, the surface can be sprayed lightly with distilled water. Then the water can be removed with a rubber squeegee.

The substantially non-distorting, clear treatment forms a coating on the glass which sheds dirt and spots and dramatically reduces cleaning maintenance. After the windows have been treated as described hereinbefore, the glass can be cleaned by simply spraying them with water through a hose. It is an important advantage of the invention that no wiping or drying is then necessary.

In areas subjected to large amounts of dirt, the treated areas can be maintained by simply spraying concentrated surfactant through a siphon container attached to a hose. After this treatment, no wiping or drying is necessary.

It is apparent that there has been provided in accordance with this invention a method of treating a surface which fully satisfies the objects, means and advantages set forth hereinbefore. While the invention has been described in combination with specific embodiments thereof, it is evident that many alternatives, modifications and variations will be apparent to those skilled in the art in light of the foregoing description. Accordingly, it is intended to embrace all such alternatives, modifications and variations as fall within the the spirit and broad scope of the appended claims.

Wherefore, we claim:

1. A method of treating a surface to form a protective coating thereon consisting essentially of a surfactant, which method comprises the steps of:

mixing the surfactant with water to form a treatment solution, wherein the surfactant is a non-water soluble surfactant and is present in an amount between about five percent to about fifteen percent by volume of the treatment solution;

applying the treatment solution to the surface to be protected to thereby wet the surface;

rubbing the solution wetted surface until a tacky residue forms on the surface; and rubbing the tacky residue on the surface until the surface is wiped free of any streaks so that all that remains on the surface is the protective coating consisting essentially of the surfactant.

2. The method of claim 1, further including the step of cleaning the surface prior to wetting sections of the surface.

3. The method of claim 1, wherein said surfactant is a liquid form, di-ester sodium dioctyl sulfosuccinate.

4. The method of claim 1, wherein water is the remainder of the total volume of the treatment solution.

5. The method of claim 1, wherein the step of rubbing the wetted surface includes using a firm circular motion until the surface is covered with the tacky residue.

6. The method of claim 1, wherein said step of mixing further includes the mixing about 7% by volume of surfactant with the remainder of the total volume being water.

7. A method of treating a surface, which method comprises the steps of:

mixing a non-water soluble surfactant with water to form a treatment solution, wherein the surfactant is between about five percent to about fifteen percent by volume of the treatment solution, and wherein said mixing step further includes mixing from about 1% to about 5% by volume of alcohol with the water and the surfactant, with the water being the remainder of the total volume of the treatment solution;

wetting sections of the surface being protected by applying the treatment solution;

rubbing the solution wetted surface until a tacky residue forms on the surface; and rubbing the tacky residue on the surface until the surface is wiped free of any streaks.

8. The method of claim 7, wherein said step of mixing further includes the mixing about 2% by volume of alcohol with the remainder of the total volume being water and surfactant.

9. The method of claim 8, wherein said step of mixing further includes the mixing about 0.1% to about 1% by volume of ultraviolet stabilizer with the remainder of the total volume being water, alcohol and surfactant.

10. The method of claim 1, wherein said step of mixing further includes the mixing about 9% by volume of surfactant with the remainder of the total volume being water.

11. The method of claim 10, wherein said step of mixing further includes the mixing about 0.1% to about 1% by volume of ultraviolet stabilizer with the remainder of the total volume being water and surfactant.

12. The method of claim 5, wherein the step of rubbing the tacky residue includes rubbing a cloth against the surface with a firm circular motion.

13. The method of claim 12, wherein the surface being treated is the finished surface of an automobile.

14. A method of treating a surface, which method comprises the steps of:

mixing a non-water soluble surfactant with water to form a treatment solution, wherein said mixing step includes mixing the water and between about 5% to about 15% by volume of surfactant and between about 1% to about 5% by volume of alcohol, with the water being the remainder of the total volume of the treatment solution;

wetting sections of the surface being protected by applying the treatment solution, wherein said step of wetting includes spraying the treatment solution onto the surface;

rubbing the solution wetted surface until a tacky residue forms on the surface; and rubbing the tacky residue on the surface until the surface is wiped free of any streaks.

15. The method of claim 14, further including the step of cleaning the surface prior to wetting sections of the surface.

16. The method of claim 15, wherein the step of rubbing the wetted surface includes:

using a back and forth movement in a first direction across the surface until the surface has the tacky residue;

waiting for the tacky residue to dry;

rubbing the wetted surface includes using a back and forth movement in a second direction across the surface, said second direction being substantially perpendicular to said first direction, until the surface has the tacky residue; and waiting for the tacky residue to dry.

17. The method of claim 16, wherein the step of rubbing the tacky residue includes:

dusting the surface being treated with a powdery substance; and rubbing the powdery substance against the surface with a firm circular motion.

18. The method of claim 17, including the step of selecting the powdery substance from the group comprising corn starch and diatomaceous earth.

19. The method of claim 18, wherein the surface being treated is a glass window of a building.

20. The method of claim 7, wherein said surfactant is a liquid form, di-ester sodium dioctyl sulfosuccinate.

21. The method of claim 14, wherein said surfactant is a liquid form, di-ester sodium dioctyl sulfosuccinate.

* * * * *